US007059265B2

(12) United States Patent
Lehman

(10) Patent No.: US 7,059,265 B2
(45) Date of Patent: Jun. 13, 2006

(54) ANTENNA PENNANT ATTACHMENT DEVICE

(76) Inventor: Michael Lehman, 12933 Caminito Bodega, Del Mar, CA (US) 92014

( * ) Notice: Subject to any disclaimer, the term of this patent is extended or adjusted under 35 U.S.C. 154(b) by 0 days.

(21) Appl. No.: 10/823,010

(22) Filed: Apr. 13, 2004

(65) Prior Publication Data

US 2004/0200107 A1 Oct. 14, 2004

Related U.S. Application Data

(60) Provisional application No. 60/462,136, filed on Apr. 14, 2003.

(51) Int. Cl.
*G09F 17/00* (2006.01)

(52) U.S. Cl. ..... 116/28 R; 116/173

(58) Field of Classification Search ..... 116/173, 116/174, 28 R; 40/591, 586, 594, 666, 607.14; 24/304, 205.3, 231.81, 316.8; D11/165, D11/166, 171, 181, 182, 183
See application file for complete search history.

(56) References Cited

U.S. PATENT DOCUMENTS

| | | | | | |
|---|---|---|---|---|---|
| 1,534,652 | A | * | 4/1925 | Lorenz | 116/173 |
| 3,138,249 | A | * | 6/1964 | Paulini | 116/2 |
| 3,242,901 | A | * | 3/1966 | Olson | 116/173 |
| 3,799,106 | A | * | 3/1974 | Lamport | 116/28 R |
| 4,590,883 | A | * | 5/1986 | Steed et al. | 116/173 |
| 4,673,153 | A | * | 6/1987 | Hilty et al. | 248/231.81 |
| 5,207,174 | A | * | 5/1993 | Fabbrini | 116/173 |
| 5,279,250 | A | * | 1/1994 | Palermo et al. | 116/174 |
| 5,517,941 | A | * | 5/1996 | Fisher | 116/173 |
| 5,881,481 | A | * | 3/1999 | Bashaw et al. | 40/593 |
| 5,943,980 | A | * | 8/1999 | Huang | 116/174 |

FOREIGN PATENT DOCUMENTS

| | | | |
|---|---|---|---|
| JP | 08146898 | A * | 6/1996 |
| JP | 10031443 | A * | 2/1998 |
| JP | 11038920 | A * | 2/1999 |
| JP | 11119716 | A * | 4/1999 |
| JP | 2004177670 | A * | 6/2004 |

* cited by examiner

*Primary Examiner*—R. Alexander Smith
(74) *Attorney, Agent, or Firm*—Steven W. Webb

(57) ABSTRACT

An improved method of attaching paper and cloth pennants and flags to automobile antennae, ropes, and the like is presented. The attachment system consists of a three-part strip of transparent adhesive material and a plastic or metal clip that are inexpensive to produce and simple to use.

3 Claims, 1 Drawing Sheet

Fig. 1
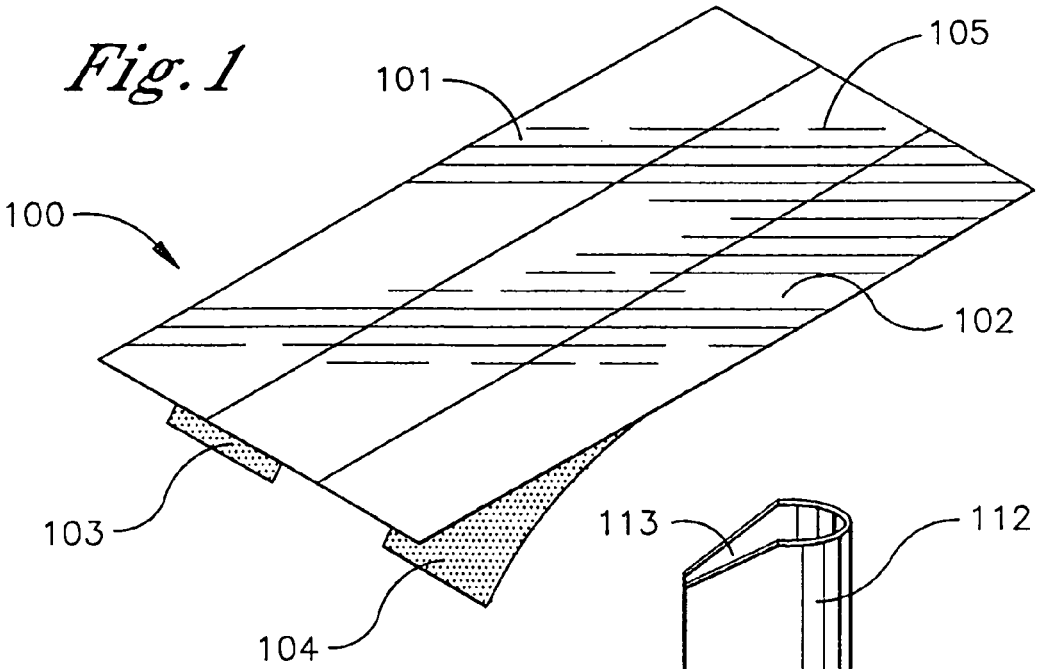
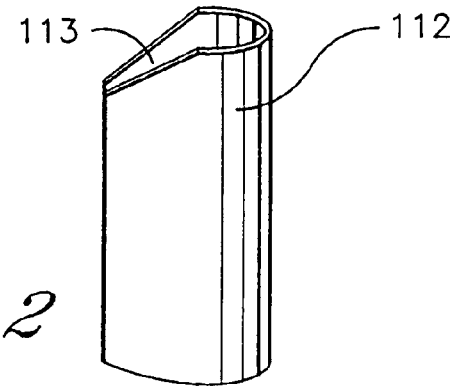
Fig. 2
Fig. 3
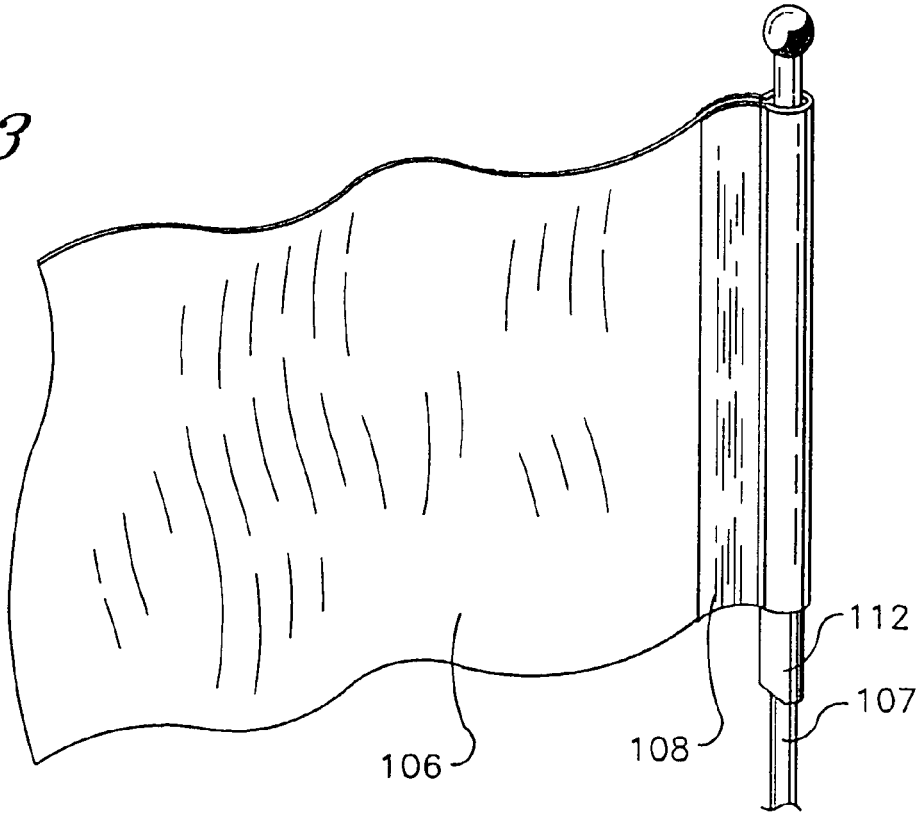

ANTENNA PENNANT ATTACHMENT DEVICE

RELATED U.S. APPLICATIONS

This application supplements and completes Provisional Application No. 60/462,136, filed Apr. 14, 2003.

BACKGROUND OF THE INVENTION

This invention relates to special mechanisms and features for displaying and affixing decorations and flags. It is related to self-adhering decals, and the like, for automobiles, motorcycles, and other vehicles and watercraft, and other masts, posts, ropes or supporting members.

BRIEF SUMMARY OF THE INVENTION

This invention is designed to provide a low-cost, flexible means to attach a light-weight pennant or flag to an automobile or other vehicle antenna mast or other vehicles and watercraft, or other masts, posts, ropes or supporting members, while preventing the flag decoration from sliding down the mast. It consists of a single rectangular sheet of transparent or translucent plastic with two strips of transparent transfer adhesive along its opposite edges. The transfer adhesive is covered by a removable plastic or paper cover, which when removed, attaches fixedly to a lightweight cloth, paper or plastic pennant or flag.

The central portion of the invention is not covered by the adhesive, and hence can be wrapped around a narrow mast, usually an automobile antenna, allowing for free rotation around the mast. A plastic clip is provided as part of the invention, that snaps over the antenna mast and has a bead of tacky adhesive inside on the back. The tacky adhesive prevents the clip from sliding down the antenna, and when placed below the pennant, prevents the pennant from sliding down the mast as well.

The adhesive on the edges of the invention is aggressive enough to hold a cloth, plastic, or paper flag while the automobile whose antenna the strip/flag assembly is attached to is subject to strong counter winds.

BRIEF DESCRIPTION OF THE DRAWINGS

The construction and operation of the invention can be readily appreciated from inspection of the drawings that accompany this application.

FIG. 1 is a perspective view of the invention.

FIG. 2 is a perspective view of the clip.

FIG. 3 is a depiction of the invention attached to a mast

DETAILED DESCRIPTION OF THE INVENTION

Referring to FIG. 1, the invention[100] in in its flat, unattached form is shown. The adhesive edges[101,102] are shown with the peelable coverings[103,104]. The invention[100] can be sized or multiplied to hold a pennant[106] or flag of any reasonable size to a straight antenna mast[107], as shown in FIG. 2. The inside of the central portion[105] is clean of any adhesive when it is placed in contact with the antenna mast[107]. The weight of the pennant[106] will be supported by the clip[112] when properly attached to the pennant[106] and placed over/around the mast[107].

The invention[100] is used by obtaining the desired pennant[106] or flag to be displayed, accompanied by a strip or multiple strips of the invention[100] long enough to accommodate the edge[108] of the pennant[106] to be attached to the mast[107], and then attaching the invention[100] to the pennant[106] and then to the mast[107]. The clip[112] is attached after the pennant[106] is placed at the desired height on the mast[107].

This is accomplished by removing one strip of the peelable strip[103], placing the adhesively[101] in contact with one side of the pennant[106] at the edge[108] to be attached to the mast[107] and smoothing the adhesive edge down. The semi-attached invention[100] plus pennant[106] can now be attached to the mast[107] by wrapping the invention central portion[105] around the mast[107], removing the remaining peelable strip[104], and then smoothing the newly uncovered adhesive[102] to the other side of the pennant[106], being careful not to let the adhesive[102] come in contact with the mast [107], so as to allow for free rotation of the pennant around the mast. The clip[112] is then slipped over the mast[107] below the pennant[106] by pressing the clip open end[113] over the cylindrical mast[107] until the clip[112] snaps into place. The pennant[106] should now stay on the mast[107] yet be able to rotate around the mast[107] as the wind directs.

While the preferred embodiment of the invention has been described, modifications can be made and other embodiments of this invention realized without departing from the intent and scope of any claims associated with this invention.

What is claimed is:

1. A pennant attachment system, comprised of a plurality of three-part adhesive strips and a mast clip, each three-part adhesive strip comprising a flat piece of material in a rectangular shape, the flat piece of transparent material possessing a non-adhesive side and an adhesive side, the non-adhesive side being clean of any adhesive material, the adhesive side possessing three rectangular sections whose long axis parallels the long axis of the three-part adhesive strip, the two outside rectangular sections of the adhesive side covered with a contact adhesive, the contact adhesive being transparent, the two outside rectangular sections of the adhesive side also possessing opaque peelable covers that completely cover the contact adhesive, the central rectangular section being clean of any adhesive material, the mast clip made from a single piece of semi-rigid material, the mast clip shaped in such a fashion that it can be opened and then placed over a slim mast, and held in place on the mast by means of a bead of tacky adhesive inside the mast clip, the mast selected from the group composed of antennas, ropes, or cables.

2. A method of using the pennant attachment system of claim 1 by obtaining a pennant to be attached to the mast, taking one of the three-part adhesive strips, said one three-part adhesive strip having sufficient length such that it covers the edge of the pennant to be attached to the mast, peeling off one one of peelable covers and attaching the corresponding outside rectangular section to the pennant edge by means of the contact adhesive, placing the central rectangular section of the three-part adhesive strip over the mast, then removing the remaining peelable cover and wrapping the three-part adhesive strip around the mast and attaching it to the other side of the edge of the pennant in such a manner that only the central rectangular section is in contact with the mast.

3. A method of using the pennant attachment system of claim 1 by obtaining a pennant to be attached to the mast, the plurality of three-part adhesive strips having sufficient length such that each strip covers the edge of the pennant to be attached to the mast, peeling off one of the peelable covers and attaching the corresponding outside rectangular section of the first three-part adhesive strip to the pennant edge by means of the contact adhesive, then attaching the second three-part peelable strip to the first one by means of uncovering the unused peelable cover of the first one and one of the peelable covers of the second one, and then bringing them into contact, adding successive peelable strips in series in this manner until a composite pennant attachment system is created long enough to encompass the mast and the last peelable cover is removed and the system is attached to the pennant.

* * * * *